US010695642B1

(12) United States Patent
Robinson

(10) Patent No.: US 10,695,642 B1
(45) Date of Patent: Jun. 30, 2020

(54) GOLF TRAINING SYSTEMS, DEVICES, METHODS, AND COMPONENTS

(71) Applicant: William G. Robinson, Wayzata, MN (US)

(72) Inventor: William G. Robinson, Wayzata, MN (US)

( * ) Notice: Subject to any disclaimer, the term of this patent is extended or adjusted under 35 U.S.C. 154(b) by 0 days.

(21) Appl. No.: 16/254,428

(22) Filed: Jan. 22, 2019

Related U.S. Application Data

(60) Provisional application No. 62/620,457, filed on Jan. 22, 2018.

(51) Int. Cl.
*A63B 57/10* (2015.01)
*A63B 69/36* (2006.01)

(52) U.S. Cl.
CPC ..... *A63B 69/3661* (2013.01); *A63B 69/3676* (2013.01)

(58) Field of Classification Search
CPC ..... A63B 57/10; A63B 57/13
USPC ..... 473/278, 279, 284, 387, 388, 402; D21/791, 792, 796
See application file for complete search history.

(56) References Cited

U.S. PATENT DOCUMENTS 1,484,064 A * 2/1924 Taylor ..... A63B 57/00 473/218
1,596,110 A * 8/1926 Lynch ..... A63B 57/10 473/218
1,761,532 A * 6/1930 Morris ..... A63B 57/10 473/218
1,783,211 A * 12/1930 Baldwin ..... A63B 57/10 473/257
1,903,480 A * 4/1933 Ryan ..... A63B 57/40 473/180
2,031,525 A * 2/1936 Clarke ..... A63B 57/40 473/180
2,087,334 A * 7/1937 Rosengarten ..... A63B 69/3655 473/278
2,096,055 A * 10/1937 Miller ..... A63B 57/10 473/257
2,461,601 A * 2/1949 Hendricks ..... A63B 57/10 473/398
D158,622 S * 5/1950 Sherwin ..... D21/791
D161,283 S * 12/1950 Rogers ..... D21/717
2,710,757 A * 6/1955 Chong ..... A63B 69/36 473/257
2,992,005 A * 7/1961 Lockhart ..... A63B 69/3676 473/257
3,424,464 A * 1/1969 Greenhouse ..... A63B 57/40 473/180
3,471,155 A * 10/1969 Donaldson ..... A63B 69/3676 473/260

(Continued)

FOREIGN PATENT DOCUMENTS

FR 2645756 A1 * 10/1990 ..... A63B 57/207
GB 2369580 A * 6/2002 ..... A63B 69/3676

(Continued)

*Primary Examiner* — Alvin A Hunter
(74) *Attorney, Agent, or Firm* — Richard John Baritz

(57) ABSTRACT

A golf training assembly has a plate structure configured for placement on a golf surface, such as a putting green. The training assembly has a mouth for receiving a rolling golf ball. The mouth guides the golf ball against a stop member for stopping and holding the golf ball in place allowing a golfer to practice putting.

18 Claims, 8 Drawing Sheets

(56) References Cited

U.S. PATENT DOCUMENTS 3,870,299 A * 3/1975 Howe ..... A63B 69/3676 473/257
3,934,882 A * 1/1976 Whittaker ..... A63B 24/0003 473/257
D244,397 S * 5/1977 Graham ..... D21/791
4,151,990 A * 5/1979 Josenhans ..... A63D 15/006 473/2
D293,261 S * 12/1987 Sadowski ..... D21/794
4,765,625 A * 8/1988 Miner ..... A63B 69/3676 473/218
D307,929 S * 5/1990 Parkerson ..... D21/791
D332,816 S * 1/1993 Tarver ..... D21/791
D338,940 S * 8/1993 Pellington ..... D21/792
5,240,254 A * 8/1993 Adlam ..... A63B 57/19 473/257
5,294,124 A * 3/1994 Florian ..... A63B 24/0003 359/838
5,332,211 A * 7/1994 Rife ..... A63B 69/3676 273/DIG. 21
D353,646 S * 12/1994 Arima ..... D21/791
5,443,265 A * 8/1995 Wheeler ..... A63B 69/3676 473/257
D364,440 S * 11/1995 Balestrieri ..... D21/791
D366,302 S * 1/1996 Marsh ..... D21/792
5,492,330 A * 2/1996 Eldridge, Jr. ..... A63B 57/00 473/265
D382,929 S * 8/1997 DeBlieux ..... D21/717
5,707,301 A * 1/1998 Tollin ..... A63B 69/3667 473/252
6,019,685 A * 2/2000 Fonseca ..... A63B 69/3676 473/265
D436,639 S * 1/2001 Haliyo ..... D21/791
6,458,039 B1 * 10/2002 Fontes ..... A63B 69/3676 473/258
6,503,152 B1 * 1/2003 Pelz ..... A63B 63/00 473/157
6,769,995 B1 * 8/2004 Rhodes ..... A63B 69/3676 473/265
6,769,999 B1 * 8/2004 Chase ..... A63B 57/19 473/386
6,840,870 B1 * 1/2005 Froggatte ..... A63B 24/0003 473/261
D504,484 S * 4/2005 Loudon ..... D21/791
D508,547 S * 8/2005 Llewellyn ..... D21/791
D524,893 S * 7/2006 Rinaldi ..... D21/791
7,074,134 B2 * 7/2006 Piche ..... A63B 69/3641 473/226
7,077,759 B1 * 7/2006 McNulty ..... A63B 69/3676 473/257
7,527,562 B1 * 5/2009 Mason ..... A63B 69/3667 473/218
7,780,553 B2 * 8/2010 Palmer ..... A63B 57/10 473/396
7,806,786 B2 * 10/2010 Joffe ..... A63B 57/10 473/386
D632,750 S * 2/2011 Callowhill ..... D21/791
7,927,228 B2 * 4/2011 Rhodes ..... A63B 69/3623 473/270
D641,448 S * 7/2011 Sessions ..... D21/791
7,997,994 B2 * 8/2011 Hensel ..... A63B 69/3623 473/257
8,016,698 B2 * 9/2011 Cameron ..... A63B 57/50 473/406
8,025,585 B2 * 9/2011 Kramski ..... A63B 69/3661 473/218
8,029,380 B1 * 10/2011 Johansen ..... A63B 69/3676 473/257
8,231,477 B2 * 7/2012 Jones ..... A63B 69/3623 473/218
8,465,377 B1 * 6/2013 Kamnikar ..... A63B 69/3676 473/266
D692,512 S * 10/2013 Fanfelle ..... D21/791
D717,898 S * 11/2014 Pfaff ..... D21/791
D732,130 S * 6/2015 Covino ..... D21/791
D794,737 S * 8/2017 Boan ..... D21/791

FOREIGN PATENT DOCUMENTS

JP 08215364 A * 8/1996
JP 2006341035 A * 12/2006
JP 2016190013 A * 11/2016

* cited by examiner

GOLF TRAINING SYSTEMS, DEVICES, METHODS, AND COMPONENTS

CROSS REFERENCE TO RELATED APPLICATION

This application claims the priority of U.S. Application Ser. No. 62/620,457 filed Jan. 22, 2018.

FIELD OF THE INVENTION

Various embodiments of the invention relate to golf training devices, particularly those suited for training in putting and driving.

BACKGROUND OF THE INVENTION

Millions of people around the world enjoy the game of golf. Despite this success, there are many in the industry who are concerned about the future of the golf industry, pointing to an estimated 20% reduction in overall participation over the past decade or so, particularly among younger players. Some attribute the reduction to the length of time that it takes to play a round of golf, the cost of playing, and the difficulty of playing.

One of the best ways to improve the performance of golfers at any level, from beginner to professional, is to improve their putting. Practice is the key to success. The present inventor has looked at numerous devices available to assist with practice, and discerned that the vast majority are not only cumbersome or inconvenient to use, but also relatively expensive to manufacture.

Accordingly, the present inventor has recognized a need for improved golf trainers that are not only simple to use, easy to carry, and inexpensive to manufacture, but also fun and effective.

SUMMARY OF THE INVENTION

To address one or more of these and/or other needs or problems, the present inventor devised, among other things, one or more exemplary systems, kits, methods, devices, assemblies, components, for use in practicing golf, particularly putting.

One exemplary embodiment takes the form of a simple molded or 3D printed plastic plate having a golf ball seat configured with a mouth or entry region to receive a rolling golf ball and guide it against a set of stopper bumps that not only stop forward movement of the ball but lock or seat the ball in place. Additionally, a back edge portion of the plate, opposite the mouth, includes a central alignment tab or in some embodiments an indentation to demarcate the central axis of the ball and provide a reference point for alignment of the face of a putter. The back edge portion of the plate is used for ensuring squareness of the putter or other clubface square with the ball, and may include a collinear arrangement of holes along its back edge to receive for example two or more golf tees to secure the trainer to a putting surface. The golf tees inserted into these holes may be spaced to also delineate a gateway of various widths, for passage of a swinging clubface. One or more portions of the plate are also configured to facilitate alignment of the trainer with desired putting direction.

One advantage of the trainer, particularly its set of bumper stops that effectively catch a rolling golf ball, is that the trainer can be easily loaded with a ball for a practice putt, by dragging a new ball into place with little or no bend over, saving the user's back and ensuring more putting repetitions per unit of time compare to conventional trainers that are more difficult to set. Moreover, the exemplary embodiments include a slot for insertion of a drive tee, which allows the directional and clubface orientation guides of the trainer to be used during driving as well.

DESCRIPTION OF THE INVENTION

Figure 1:
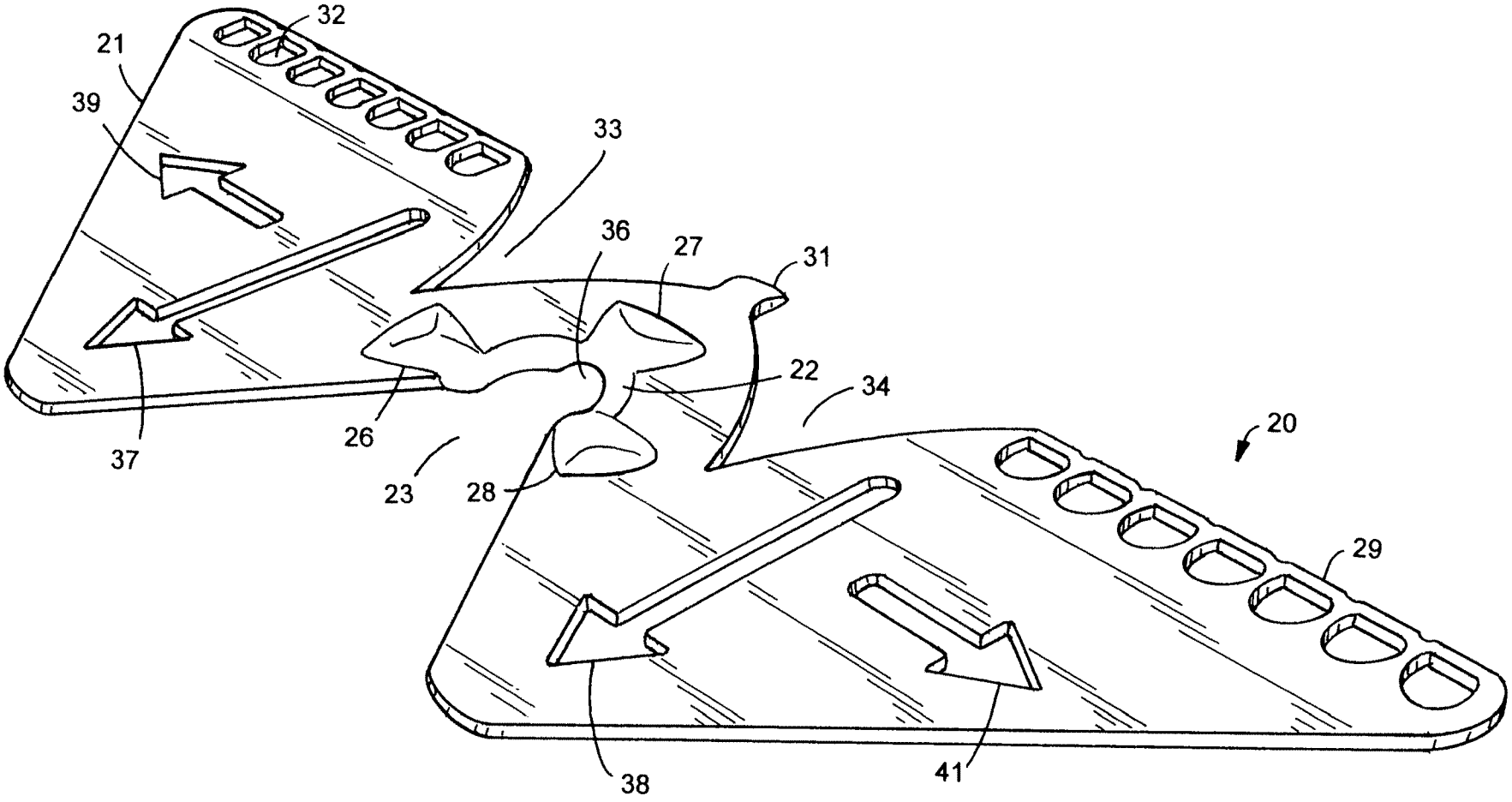
FIG. 1 is a perspective view of the golf trainer of the invention.
Figure 2:
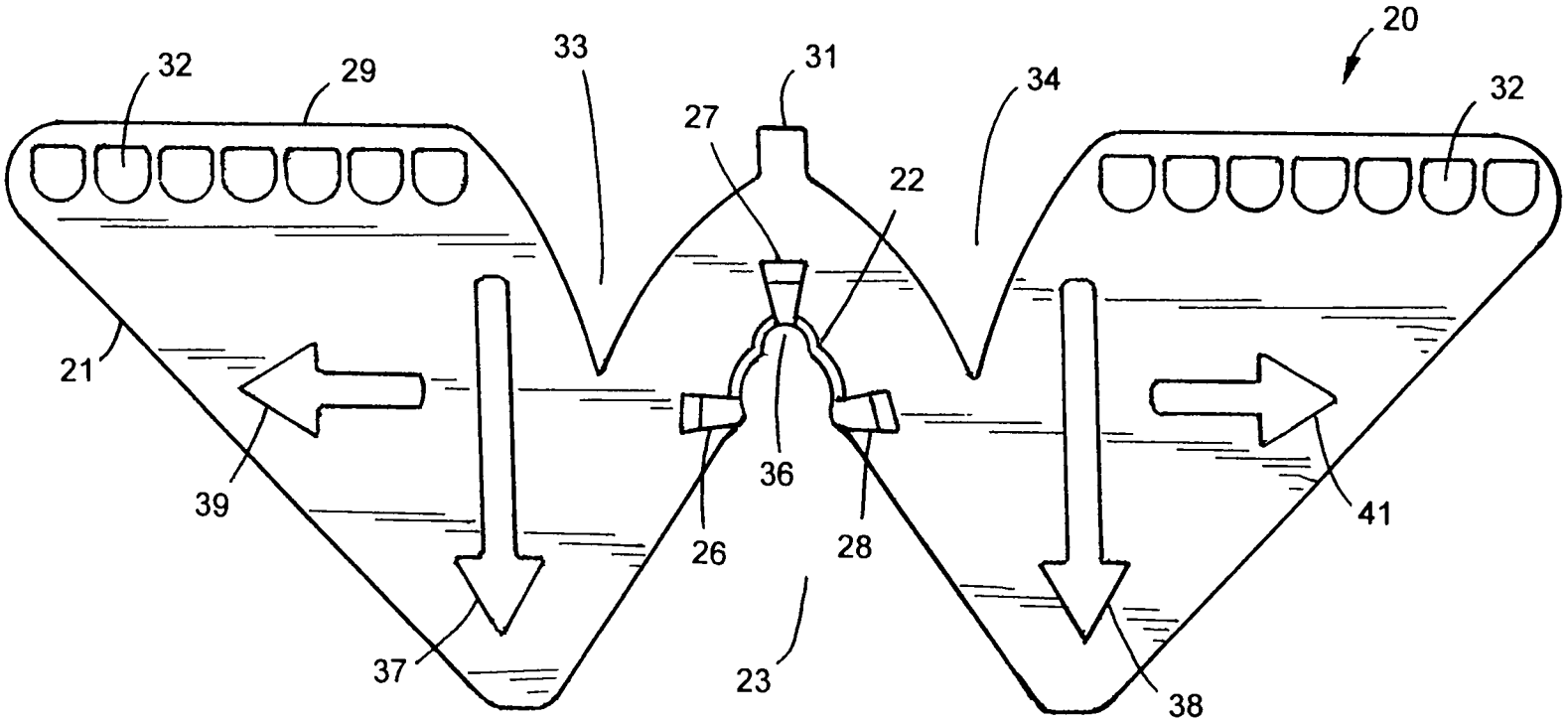
FIG. 2 is a top plan view of the golf trainer of FIG. 1.
Figure 3:
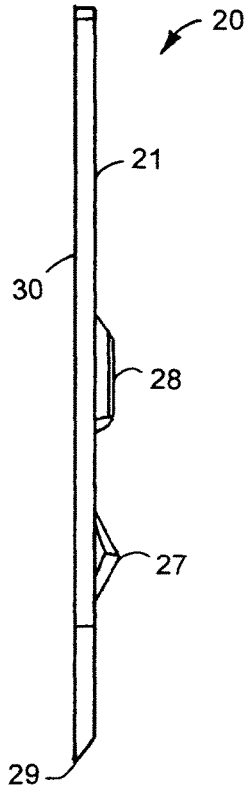
FIG. 3 is an elevated side view of the golf trainer of FIG. 1.
Figure 4:
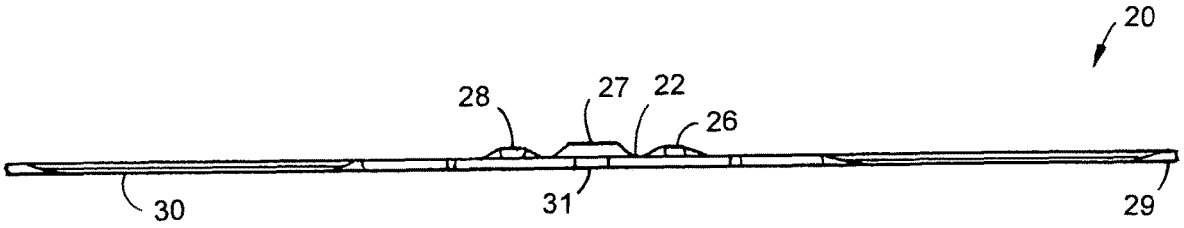
FIG. 4 is an elevated back view of the golf trainer of FIG. 1.
Figure 5:
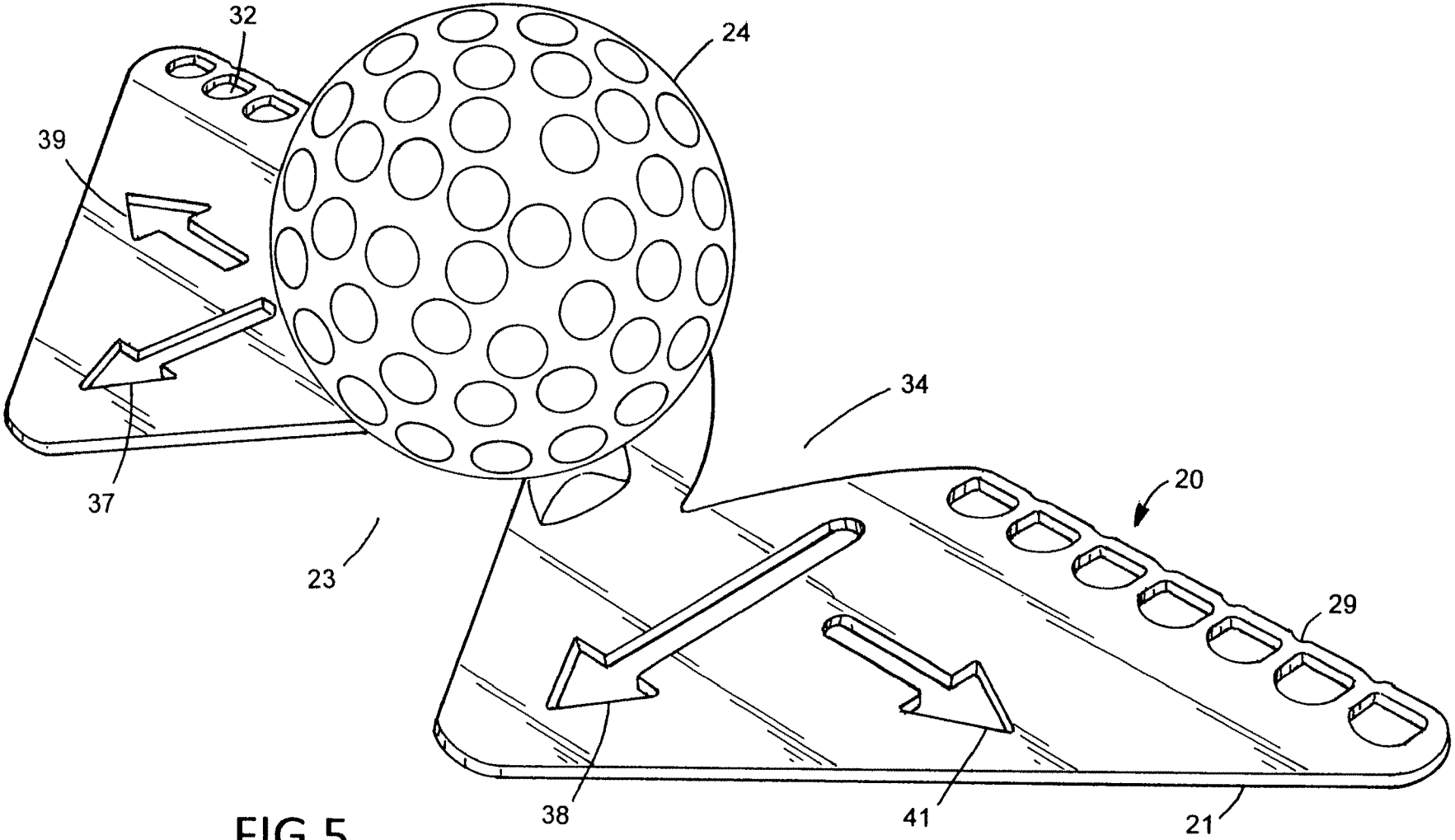
FIG. 5 is a perspective view of the golf trainer of FIG. 1 loaded with a golf ball.
Figure 6:
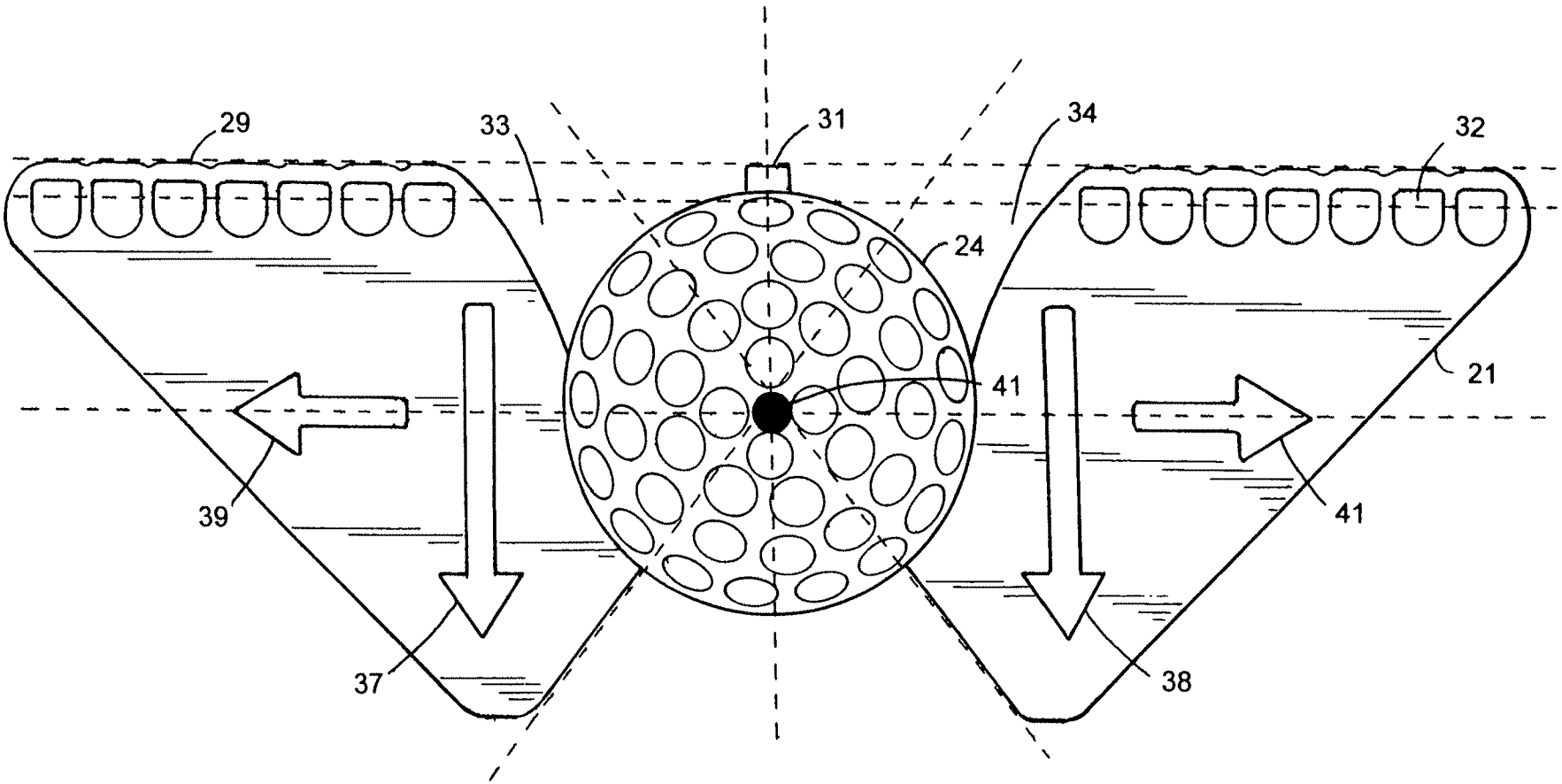
FIG. 6 is a top plan view of the golf trainer of FIG. 1 loaded with a golf ball showing the central axis of the ball.

The following detailed description of the golf trainer, which incorporates drawings, describes one or more specific embodiments of one or more inventions. These embodiments, offered not to limit but only to exemplify and teach the invention, are shown and described in sufficient detail to enable those skilled in the art to implement or practice the invention(s). Thus, where appropriate to avoid obscuring the invention(s), the description may omit certain information known to those of skill in the art.

Referring to FIGS. 1 to 6, there is shown a golf trainer indicated generally at 20 suited for training in putting and driving. Trainer 20 includes a W-shaped plate 21 having a flat bottom surface 30 for placement on a golf surface. Plate 21 has an open wedge-shaped entry region or mouth 23 adapted to receive a rolling golf ball 24 and guide and funnel golf ball 24 toward a golf ball seat 22. Seat 22 has a set of three bumper stops 26, 27 and 28 that catch and retain ball 24 for putting. Plate 21 is preferably a simple molded or 3D printed plastic plate. Other semi rigid materials such as composites, cardboards and the like can be used to make plate 21. Plate 21 can be made to have a generally rectangular shape, if desired. Stops 26, 27 and 28 stop forward movement of ball 24 and lock or seat ball 24 in place on seat 22 for putting. Center stop 27 has a higher elevation than side stops 26 and 28 to lock ball 24 in place on seat 22. Stops 26, 27 and 28 effectively catch a rolling golf ball whereby trainer 20 can be easily loaded with a ball for a practice putt by dragging a different ball into place with minimal effort without bending over, saving a user's back and ensuring more putting reps over shorter periods of time. Seat 22 can have other shapes and configurations such as an annular ring shape with a single rear bumper stop.

A back edge portion 29 of plate 21 opposite mouth 23 includes a butterline or central alignment tab 31 to demarcate the central axis 41 of ball 24 and provide a reference point for alignment of a putter and facilitate striking the center of ball 24. Tab 31 can also be an indentation on back edge portion 29 to indicate the alignment reference point.

Back edge portion 29 of plate 21 is a straight edge which is perpendicular to central axis 41 of ball 24 when ball 24 is located on seat 22. Back edge portion 29 is used to facilitate positioning a putter square with ball 24. A collinear arrangement of holes 32 along back edge portion 29 are adapted to receive fasteners such as two or more golf tees to secure trainer 20 to a putting surface. Plate 21 has open V-shaped spaces 33 and 34 adjacent opposite sides of tab 31 to make tab 31 more visible to a user. Lateral arrow cutout indicators 39 and 41 in plate 21 show where ball placement is relative to the legs of the user. Vertical arrow cutout indicators 37 and 38 in plate 21 aid alignment with the target and with alignment with the user's feet. A cutout or slot 36 in plate 21 adjacent the front of seat 22 is adapted to receive a golf tee and allow directional and clubface orientation guides for use in practicing golf driving. Indicators 37, 38, 39 and 41 facilitate directional alignment during driving.

Figure 7:
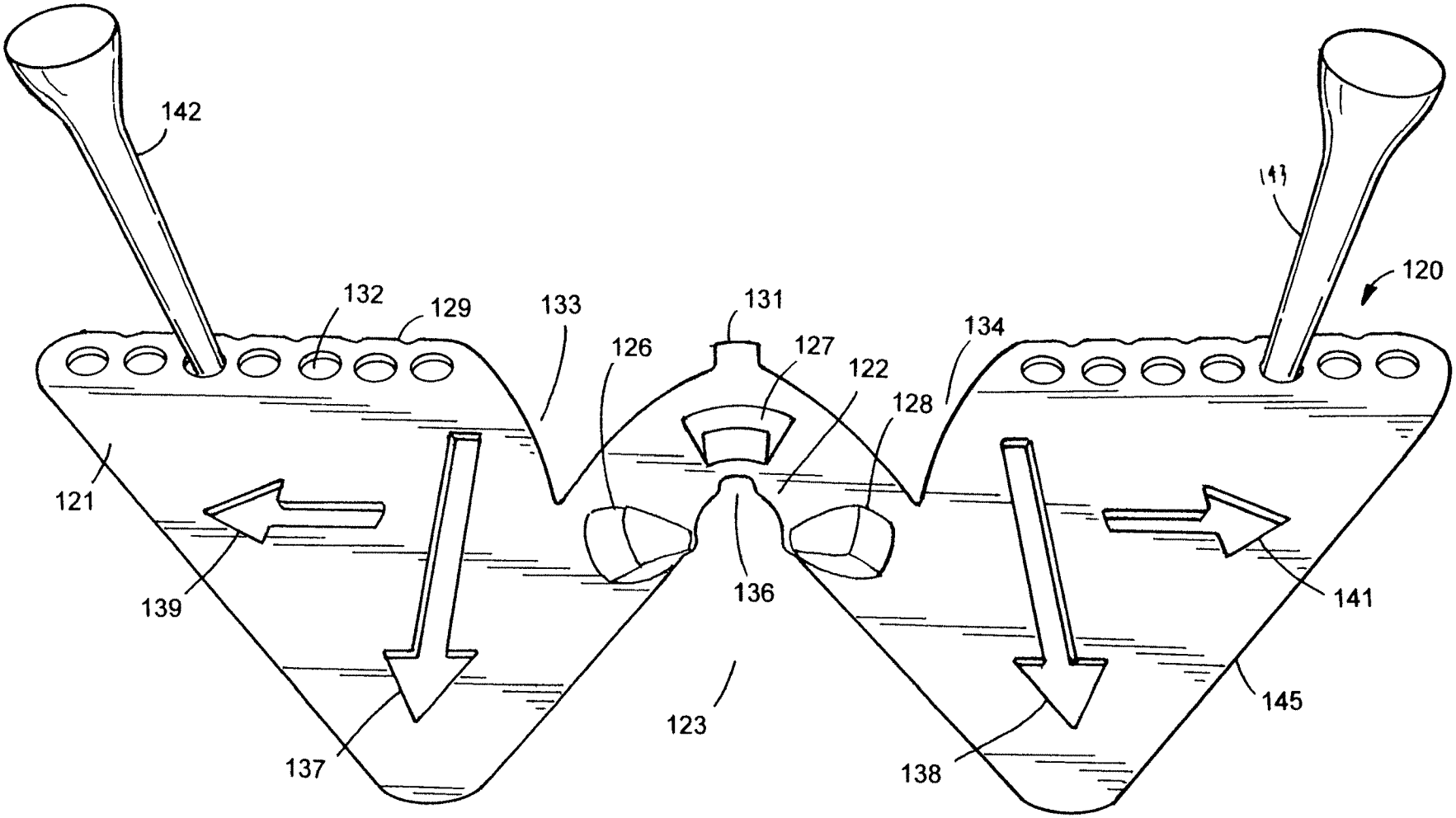
FIG. 7 is a perspective view of a modification of the golf trainer.
Figure 8:
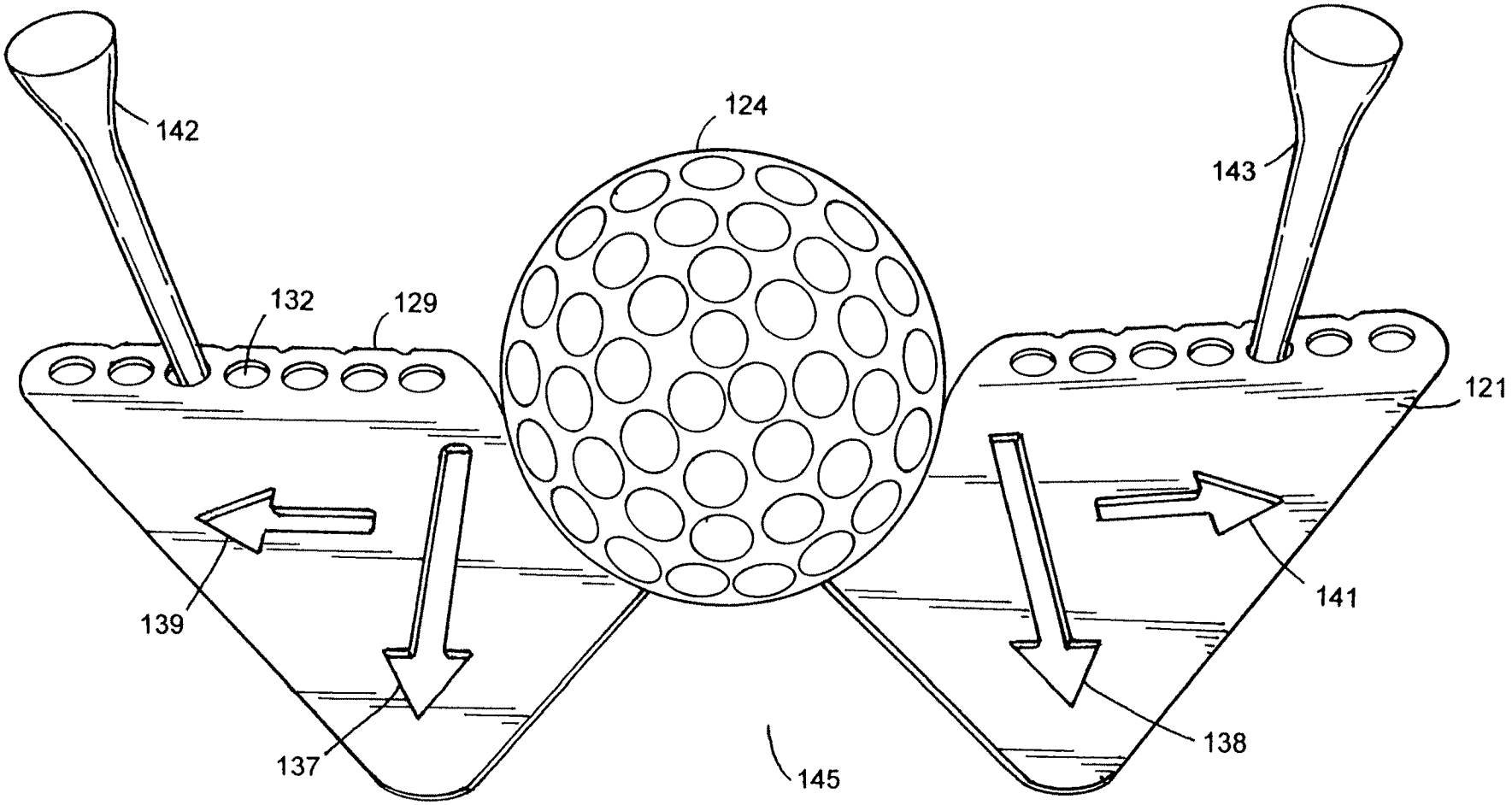
FIG. 8 is a perspective view of the golf trainer of FIG. 9 loaded with a golf ball.
Figure 9:
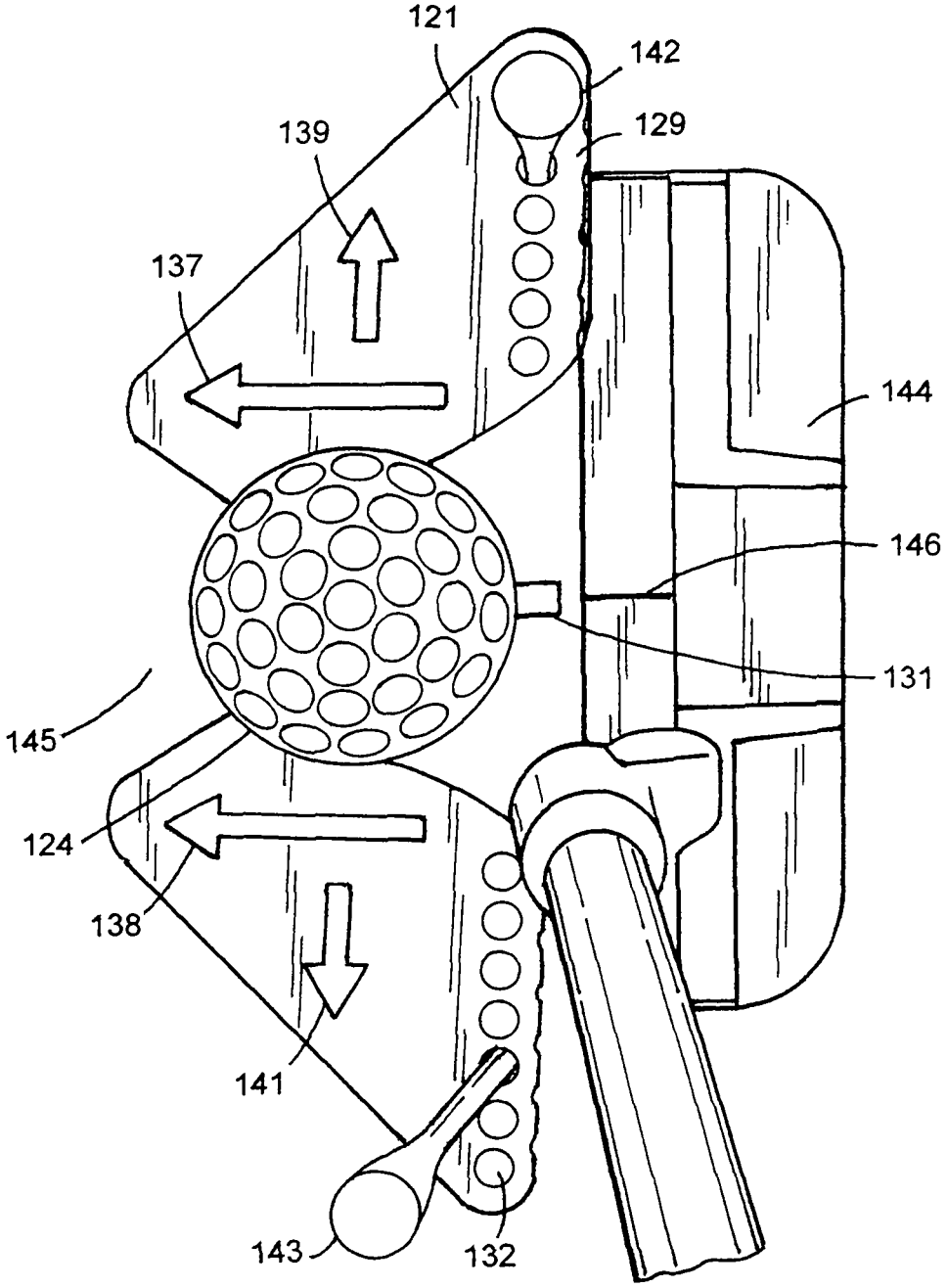
FIG. 9 is a top plan view of the golf trainer of FIG. 9 showing a putter aligned with the golf trainer.

Referring to FIGS. 7 to 9 there is shown a modification of the golf trainer indicated generally at 120 for use in putting and driving training. Trainer 120 is a plate 121 having a flat bottom surface for placement on a golf surface 145. Plate 121 has a open wedge-shaped mouth 123 adapted to receive and funnel a rolling ball 124 toward a golf ball seat 122. Seat 122 has a plurality of elevated bumper stops 126, 127 and 128 adapted to catch and retain ball 24 for putting. Stops 126, 127 and 128 stop forward movement of ball 124 and lock or seat ball 124 in place on seat 122 for putting. Center stop 127 has a higher elevation than side stops 126 and 128 to lock ball 124 in place on seat 122.

Plate 121 has back edge portion 129 opposite mouth 123. Back edge portion 129 includes a butterline or central alignment tab 131 to demarcate the central axis of ball 124 and provide a reference point for alignment of the butterline 146 of a putter 144 and facilitate striking the center of ball 124 with putter 144. Back edge portion 129 of plate 121 is a scalloped edge which is generally perpendicular to the central axis of ball 124 when ball 124 is located on seat 122. Back edge portion 129 is useable to facilitate positioning and alignment of putter 144 square with ball 124, as shown in FIG. 9. A collinear arrangement of holes 132 along back edge portion 129 are adapted to receive fasteners or anchors such as two or more golf tees 142 and 143 to secure trainer 120 to golf surface 145. Tees 142 and 143 can be spaced to define a gage therebetween and delineate a gateway of various widths for passage of putter 144 or a swing clubface.

Plate 121 has open V-shaped spaces 133 and 134 adjacent opposite sides of tab 131 to make tab 131 more visible to a user. Lateral arrow indicators 139 and 141 in plate 121 indicate ball placement relative to the legs of a user. Vertical arrow indicators 137 and 138 in plate 121 aid alignment with a target and the user's feet. Indicators 137, 138, 139 and 141 are cutouts in plate 121. A cutout or slot 136 in plate 121 adjacent the front of seat 122 is adapted to receive a golf tee for use in practicing golf driving. Indicators 137, 138, 139 and 141 facilitate directional alignment during driving.

In use, trainer 120 is loaded with a golf ball 124 by dragging ball 124 into mouth 123 onto seat 122. Stops 126, 127 and 128 effectively catch and retain ball 124 whereby trainer 120 can be easily successively loaded with a ball for practice putting by dragging successive balls into place with minimal effort without bending over, saving a user's back and ensuring more putting repetitions over a shorter period of time.

In the foregoing specification, specific exemplary embodiments have been described. However, one of ordinary skill in the art appreciates that various modifications and changes can be made without departing from the scope of the invention as set forth in the claims. Accordingly, the specification and figures are to be regarded in an illustrative rather than a restrictive sense, and all such modifications are intended to be included within the scope of the present teachings.

The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

Moreover in this document, relational terms, such as second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process method, article, or apparatus that comprises, has, includes, contains a list of elements does not include only those elements but may include other elements not expressly listed or inherent to such process, method, article, or apparatus. An element proceeded by "comprises a", "has . . . a," "includes . . . a," "contains . . . a," does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limited embodiment the term is to be within 10%, in another embodiment within %5, in another embodiment with 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed. Also, the term "exemplary" is used as an adjective herein to modify one or more nouns, such as embodiment, system, method, device, and is meant to indicate specifically that the noun is provided as a non-limiting example.

The invention claimed is:

1. A golf training device comprising:

a plate member configured for placement on a golf surface, the plate member having a mouth for receiving a golf ball rolling on the golf surface, the mouth having a seat member for stopping and holding the golf ball in a putting position for a practice putt, the plate member having a back edge extending perpendicular to the central axis of the golf ball.

2. The golf training device of claim 1 wherein:

the plate member has a central alignment tab to demarcate the central axis of the golf ball.

3. The golf training device of claim 2 wherein:

the plate member has open V-shaped spaces on opposite sides of the central alignment tab.

4. The golf training device of claim 1 wherein:

the seat member has a plurality of stop members, the stop members cooperating with each other to hold the golf ball in the putting position.

5. The golf training device of claim 1 wherein:

the plate member has vertical indicators to aid alignment with a target and the feet of a user.

6. The golf training device of claim 1 wherein:

the plate member has lateral indicators to indicate ball placement relative to the legs of a user.

7. The golf training device of claim 1 wherein:

the plate has a slot located adjacent the front of the seat member for accommodating a golf tee to allow for a practice drive.

8. A training device for use in practicing golf comprising:

a plate member, the plate member having an entry portion adapted to receive a golf ball, the plate member having a flat bottom for placement on a golf surface, the entry portion having a seat member, the seat member including a stop member for stopping and holding the golf ball in a putting position for a practice putt, the plate member having a back edge portion, and a collinear arrangement of holes extending along the back edge portion, the holes adapted to receive anchor members to secure the plate member to the golf surface, the anchor members delineating a gateway of varying widths for passage of a putter or a swing clubface.

9. The training device of claim 8 wherein:

the back edge portion extends perpendicular to the central axis of the golf ball.

10. The training device of claim 8 wherein:

the anchor members are two or more golf tees.

11. The training device of claim 8 wherein:

the plate member has a central alignment tab to demarcate the central axis of the golf ball.

12. The training device of claim 11 wherein:

the plate member has open V-shaped spaces on opposite sides of the central alignment tab.

13. The training device of claim 8 wherein:

the plate member has vertical indicators to aid alignment with a target and the feet of a user, the plate member having lateral indicators to indicate ball placement relative to the legs of a user.

14. The training device of claim 8 wherein:

the plate member is a molded or 3D printed plastic plate.

15. A method of training a golfer to golf comprising:

providing a plate member, placing the plate member on a golf surface, receiving a golf ball rolling on the golf surface with the plate member, stopping and holding the golf ball in a putting position on the plate member for a practice putt, and providing the plate member with an alignment tab for demarcating the central axis of the golf ball.

16. The method of claim 15 including:

providing the plate member with directional and clubface orientation guides.

17. The method of claim 15 including:

anchoring the plate member to the golf surface with anchor members, and delineating a gateway of varying widths with the anchor members for passage of a swing clubface.

18. The method of claim 15 including:

providing a slot in the plate member adjacent the putting position for accommodating a golf tee to allow for a practice drive.

* * * * *